US006419231B1

(12) United States Patent
Rivera

(10) Patent No.: US 6,419,231 B1
(45) Date of Patent: Jul. 16, 2002

(54) VOCABULARY BOARD GAME

(76) Inventor: Jaime Rivera, 7408 Central Park Cir., Tampa, FL (US) 33637

( * ) Notice: Subject to any disclaimer, the term of this patent is extended or adjusted under 35 U.S.C. 154(b) by 0 days.

(21) Appl. No.: 09/571,609

(22) Filed: May 15, 2000

(51) Int. Cl.[7] ..... A63F 3/00
(52) U.S. Cl. ..... 273/271; 273/299; 273/272
(58) Field of Search ..... 273/269, 236, 273/270, 299, 272, 271

(56) References Cited

U.S. PATENT DOCUMENTS 3,197,891 A * 8/1965 Pierce
3,464,124 A * 9/1969 Lynd
4,021,937 A * 5/1977 Kravitz
5,083,795 A * 1/1992 Severson
5,139,270 A * 8/1992 Gernhofer
5,338,042 A * 8/1994 Greer
5,458,338 A * 10/1995 Beardsley
5,467,996 A * 11/1995 Greer
5,685,541 A * 11/1997 Lovell
6,254,097 B1 * 7/2001 Larner

* cited by examiner

*Primary Examiner*—Benjamin H. Layno
*Assistant Examiner*—Vishu K. Mendiratta
(74) *Attorney, Agent, or Firm*—Michael I. Kroll

(57) ABSTRACT

The present invention discloses a game for helping children to learn the alphabet. The game includes multiple game boards 10 with 9-3 letter words 15 thereon presented in a 3×3 matrix which game boards are given to each player. A designated player reads a vocabulary card 60 from a deck of randomly shuffled cards 60 which contain the three-letter words 15 shown on the game boards 10. If a player's game board 10 contains the word 15 read form the vocabulary card 60, the player places a token 80 over that word. The first player to get three tokens 80 in a row, either vertically, horizontally, or diagonally, wins the game.

10 Claims, 8 Drawing Sheets

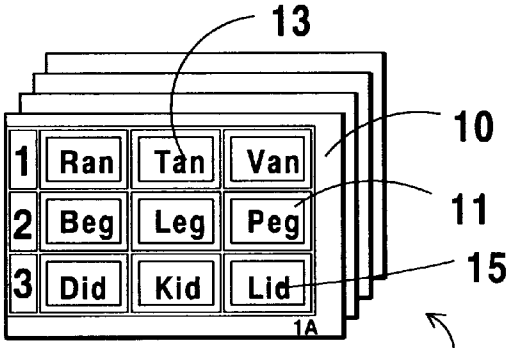
FIG 1 FIG'S 1A-1D
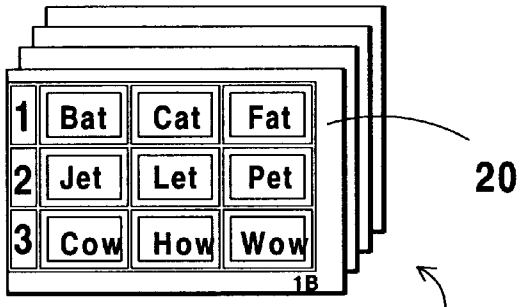
FIG 2 FIG'S 2A-2D
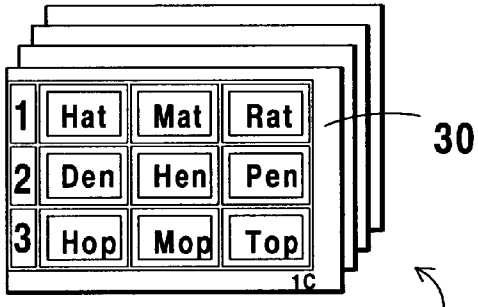
FIG 3 FIG'S 3A-3D
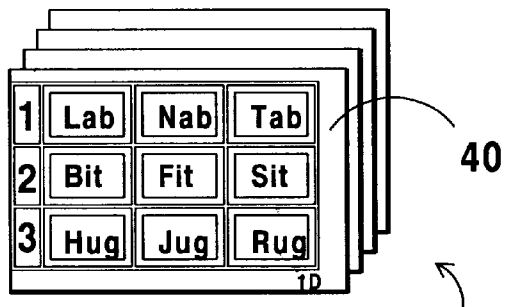
FIG 4 FIG'S 4A-4D
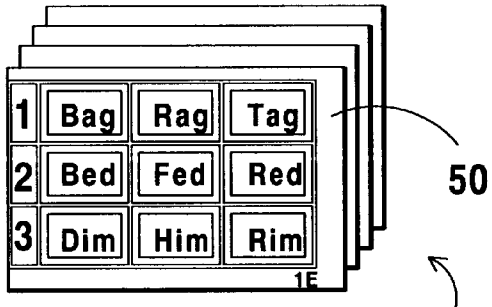
FIG 5 FIG'S 5A-5D
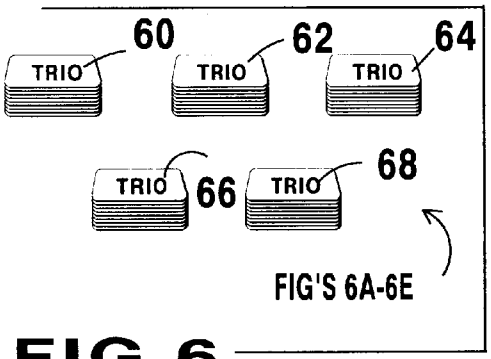
FIG 6 FIG'S 6A-6E
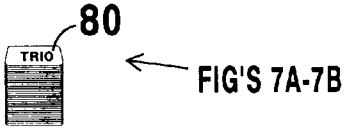
FIG 7 FIG'S 7A-7B

VOCABULARY BOARD GAME

BACKGROUND OF THE INVENTION

1. Field of the Invention

The present invention relates generally to board games and, more specifically, to a vocabulary board game using one or more boards, a deck of vocabulary cards for each board set and a deck of placement cards to be used for all board sets.

2. Description of the Prior Art

There are other vocabulary board games. Typical of these is U.S. Pat. No. 4,684,136 issued to Turner on Aug. 4, 1987.

Another patent was issued to Bryson on May 31, 1994 as U.S. Pat. No. 5,316,482. Yet another U.S. Pat. No. 5,601,288 was issued to White et al. on Feb. 11, 1997 and still yet another was issued on Mar. 18, 1997 to Ehrenfeucht as U.S. Pat. No. 5,611,538.

A game apparatus is provided and consists of nine tic-tac-toe arrangements whereby two teams answer questions until three tic-tac-toe arrangements are won in a vertical, horizontal or diagonal row to completely win the game.

A vocabulary board game is provided which consists of a game board, vowel cube playing pieces, a die, a color cube, a star cube, free pass tokens, point tokens, scoring method cards, vocabulary cards, playing position cards, a timer, pencils, pads of paper and storage files for the vocabulary cards. The object of the game is for a player to accumulate as many points as possible to beat the opponent by knowledge of vocabulary words, stopping on the player's own vowel space on the game board by the roll of the die and rolling a star on the star cube.

A game board defining a playing surface that has a plurality of box-like spaces. The box-like spaces have a color and numerical indicia printed thereon. Each box-like space is adjacent at least one other box-like space. Included are a plurality of red chips that have a top side and a bottom side. The red chips are positionable on the box-like spaces of the game board. A plurality of blue chips are included. The blue chips have a top side and a bottom side and a positionable on the box-like spaces of the game board. Lastly, two decks of playing cards are provided. Each deck consists of a plurality of cards that have an underside. One of the cards of the plurality of cards is pulled from one of the decks of cards. The underside of some of the cards have numerical indicia thereon for matching the numerical indicia on the game board to initiate placement of one of the red or blue chips on the box-like spaces.

Board game apparatus of the Tic Tac Toe variety consisting of a pair of square matrix grid game boards each containing a square grid playing area defined by a plurality of grid units existing in a number of criss cross and diagonal rows. Each of the grid units is capable of containing a game playing piece or other designation for at least partially covering the grid unit in which logical deployment of a plurality of game playing pieces are used by players during alternating designated turns to cover an entire row of the grid units on one of the boards to determine the winner of the game. Each of the boards contains sixteen grid units identification symbols, all of the symbols on each board being different from each other and both boards containing the same number of grid units, thus the same number of symbols. The symbols are arranged in a random pattern on one of the boards and in a different pattern on the other board so that none of the symbols on the second board are located on the same grid unit as on the first board.

While these board games may be suitable for the purposes for which they where designed, they would not be as suitable for the purposes of the present invention as heretofore described. It is thus desirable to provide a vocabulary board game where a number of boards comprising a set with a matching set of vocabulary cards, can be substituted and rotated between the players after each game thereby eliminating any player from memorizing a sound to a position on the board as well as providing for a more diverse vocabulary list.

SUMMARY OF THE PRESENT INVENTION

The present invention discloses a game for helping children to learn the alphabet. The game includes multiple game boards with 9-3 letter words thereon presented in a 3×3 matrix which game boards are given to each player. A designated player reads a vocabulary card from a deck of randomly shuffled cards which contain the three-letter words shown on the game boards. If a player's game board contains the word read form the vocabulary card, the player places a token over that word. The first player to get three tokens in a row, either vertically, horizontally, or diagonally, wins the game.

The present invention relates generally to board games and, more specifically, to a vocabulary board game using one or more boards, a deck of vocabulary cards for each board set and a deck of placement cards to be used for all board sets.

A primary object of the present invention is to provide a vocabulary game whereby children can be taught vocabulary in an entertaining way.

Another object of the present invention is to provide a vocabulary game board which can be used either for a small or a large group of children.

A further object of the present invention is to provide a vocabulary board game with a number of game boards that are divided into sets with a matching set of vocabulary cards. Since the cards are associated to a set of board less time is spent reading vocabulary cards for board set which are not being used.

Additional objects of the present invention will appear as the description proceeds.

To the accomplishment of the above and related objects, this invention may be embodied in the form illustrated in the accompanying drawings, attention being called to the fact however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

FIG. 1 is a perspective view of the first set of vocabulary game boards.

FIG. 2 is a perspective view of the second set of vocabulary game boards.

FIG. 3 is a perspective view of the third set of vocabulary game boards.

FIG. 4 is a perspective view of the fourth set of vocabulary game boards.

FIG. 5 is a perspective view of the fifth set of vocabulary game boards.

FIG. 6 is a perspective view of a number of sets of vocabulary reading cards.

FIG. 7 is a perspective view of a deck of placement cards which are placed on the vocabulary board to cover the words which have been read.

LIST OF REFERENCE NUMERALS

Figure 1A:
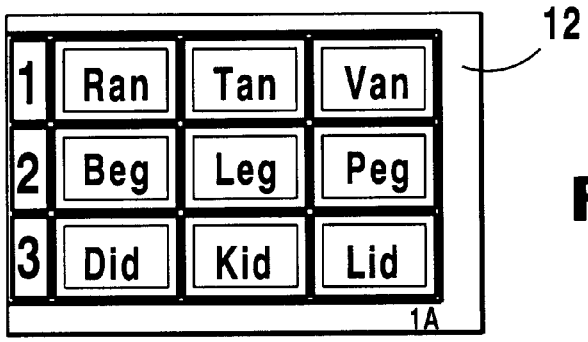
FIG. 1A is a top plan view, taken from FIG. 1 as indicated, showing one of the vocabulary boards in the first set of the vocabulary board game.

With regard to reference numerals used, the following numbering is used throughout the drawings.

10 first set of game boards
11 playing surface
12 game board
13 block
14 game board
15 word
16 game board
16 game board
18 game board
20 second set of game boards
22 game board
24 game board
26 game board
28 game board
30 third set of game boards
32 game board
34 game board
36 game board
38 game board
40 fourth set of game boards
42 game board
44 game board
46 game board
48 game board
50 fifth set of game boards
52 game board
54 game board
56 game board
58 game board
60 vocabulary cards
62 vocabulary cards
64 vocabulary cards
66 vocabulary cards

68 vocabulary cards
70 vocabulary cards
72 vocabulary cards
74 vocabulary cards
76 vocabulary cards
78 vocabulary cards
80 token
82 token top
84 token bottom
86 game board

DESCRIPTION OF THE PREFERRED EMBODIMENT(S)

Turning now descriptively to the drawings, in which similar reference characters denote similar elements throughout the several views, FIGS. 1 through 8 illustrate the present invention being a game for helping children to learn how to read through sound patterns.

The name of the game is "Trio". It is designed for children in the age range of 4–6 years. The game contents include the following: (1) 20 game boards organized into 5 sets having 4 boards to each set. Set "A" comprises 4 boards designated and having imprinted thereon 1A–4A; Set "B" comprises 4 boards designated and having imprinted thereon 1B–4B; Set "C" comprises 4 boards designated and having imprinted thereon 1C–4C; Set "D" comprises 4 boards designated and having imprinted thereon 1D–4D; and, Set "E" comprises 4 boards designated and having imprinted thereon 1E–4E; (2) 180 game vocabulary cards. Each vocabulary card displays a word and an alpha-numeric designation matching one of the game boards (example: game card 1A is a match to game board 1A). There are 9 vocabulary cards to each game board; and, (3) 180 tokens.

The game can be played by 2–20 players. The following rules explain how to play the game: (1) each player receives 1 game board; (2) each player receives 9 tokens; (3) one of the players is chosen to read the game vocabulary cards; (4) use only the game vocabulary cards that match the alpha-numeric designation on the game boards that are being used by each player; (5) shuffle the cards and place them in one pile with game vocabulary word facing down; (6) the player chosen to read the vocabulary cards will begin by picking up a card and reading it (example: 3-Hug), giving all players enough time to look on their board to see if they have the word on their board; (7) if a player has the word on their board, they place a token over the word; (8) if a player doesn't have the word on their board, they will have to wait for the next word to be read; (9) continue process 6 through 8; and, (10) the first player to get three tokens in a row be it vertically, horizontally, or diagonally wins, and can be the first to say "TRIO" wins.

Turning to FIG. 1, shown therein is a perspective view of the first set of game boards 10. Each board has a playing surface 11 having nine spaces or blocks 13 thereon arranged in a 3×3 matrix having a simple three letter word 15 in each block.

Turning to FIG. 1A, shown therein is a top plan view, taken from FIG. 1 as indicated, showing one of the game boards 12 in the first set of the board game.

Figure 1B:
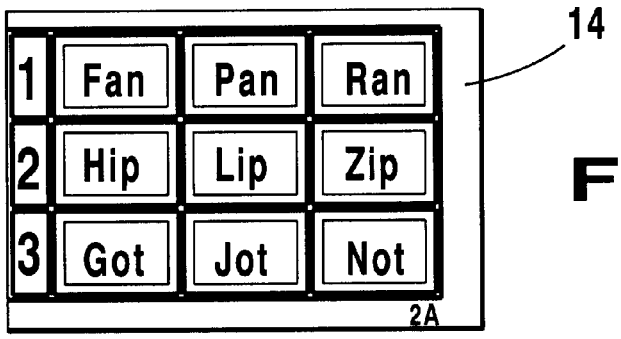
FIG. 1B is a top plan view, taken from FIG. 1 as indicated, showing another of the vocabulary boards in the first set of the vocabulary board game.

Turning to FIG. 1B, shown therein is a top plan view, taken from FIG. 1 as indicated, showing another of the game boards 14 in the first set of the board game.

Figure 1C:
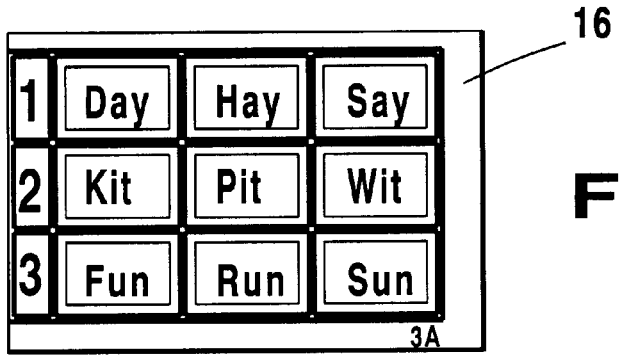
FIG. 1C is a top plan view, taken from FIG. 1 as indicated, showing another of the vocabulary boards in the first set of the vocabulary board game.

Turning to FIG. 1C, shown therein is a top plan view, taken from FIG. 1 as indicated, showing another of the game boards 16 in the first set of the board game.

Figure 1D:
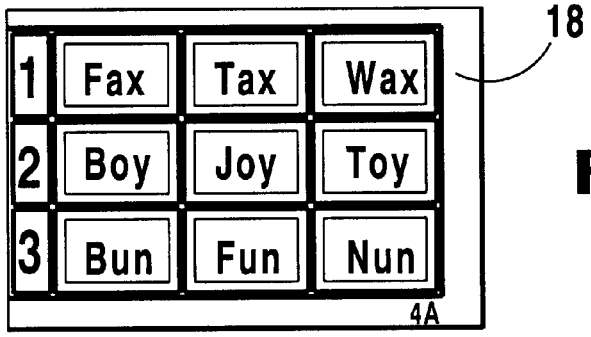
FIG. 1D is a top plan view, taken from FIG. 1 as indicated, showing another of the vocabulary boards in the first set of the vocabulary board game.

Turning to FIG. 1D, shown therein is a top plan view, taken from FIG. 1 as indicated, showing another of the game boards 18 in the first set of the board game.

Turning to FIG. 2, shown therein a perspective view of the second set of game boards 20.

Figure 2A:
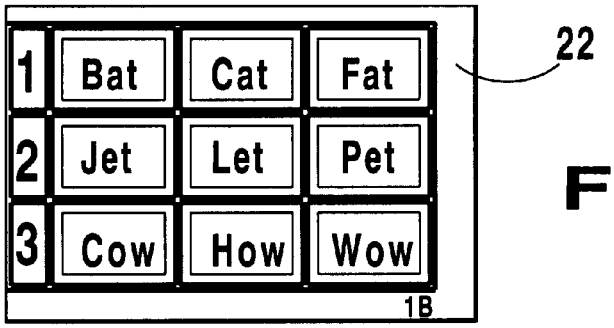
FIG. 2A is a top plan view, taken from FIG. 2 as indicated, showing one of the vocabulary boards in the second set of the vocabulary board game.

Turning to FIG. 2A, shown therein is a top plan view, taken from FIG. 2 as indicated, showing one of the game boards 22 in the second set of the board game.

Figure 2B:
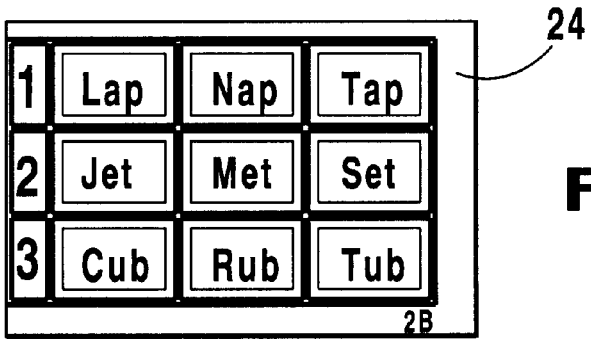
FIG. 2B is a top plan view, taken from FIG. 2 as indicated, showing another of the vocabulary boards in the second set of the vocabulary board game.

Turning to FIG. 2B, shown therein is a top plan view, taken from FIG. 2 as indicated, showing another of the game boards 24 in the second set of the board game.

Figure 2C:
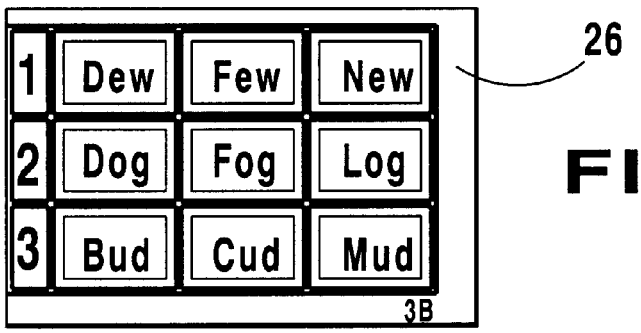
FIG. 2C is a top plan view, taken from FIG. 2 as indicated, showing another of the vocabulary boards in the second set of the vocabulary board game.

Turning to FIG. 2C, shown therein is a top plan view, taken from FIG. 2 as indicated, showing another of the game boards 26 in the second set of the board game.

Figure 2D:
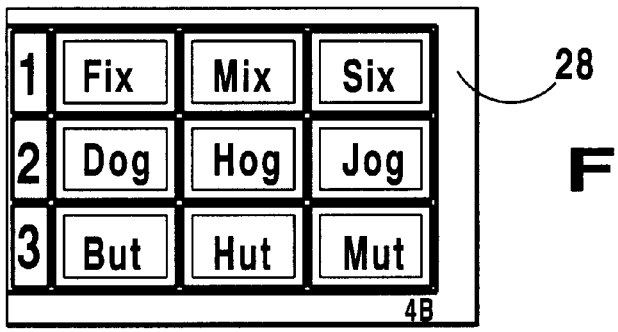
FIG. 2D is a top plan view, taken from FIG. 2 as indicated, showing another of the vocabulary boards in the second set of the vocabulary board game.

Turning to FIG. 2D, shown therein is a top plan view, taken from FIG. 2 as indicated, showing another of the game boards 28 in the second set of the board game.

Turning to FIG. 3, shown therein is a perspective view of the third set of game boards 30.

Figure 3A:
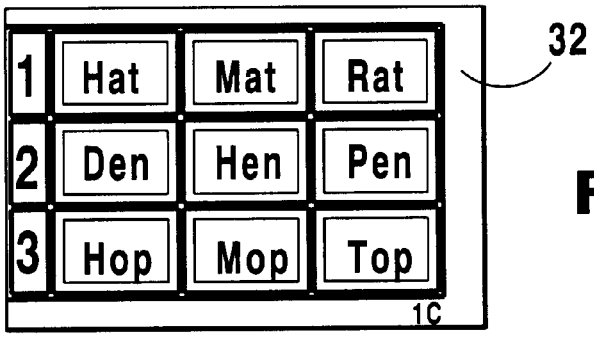
FIG. 3A is a top plan view, taken from FIG. 3 as indicated, showing one of the vocabulary boards in the third set of the vocabulary board game.

Turning to FIG. 3A, shown therein is a top plan view, taken from FIG. 3 as indicated, showing one of the game boards 32 in the third set of the board game.

Figure 3B:
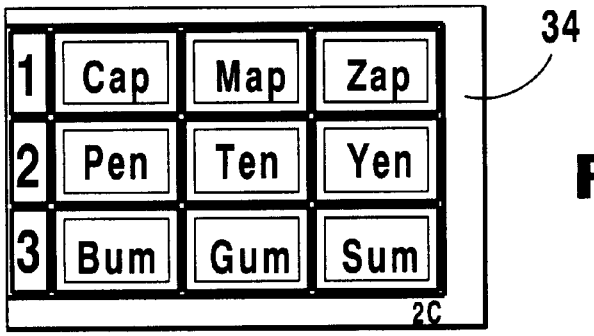
FIG. 3B is a top plan view, taken from FIG. 3 as indicated, showing another of the vocabulary boards in the third set of the vocabulary board game.

Turning to FIG. 3B, shown therein is a top plan view, taken from FIG. 3 as indicated, showing another of the game boards 34 in the third set of the board game.

Figure 3C:
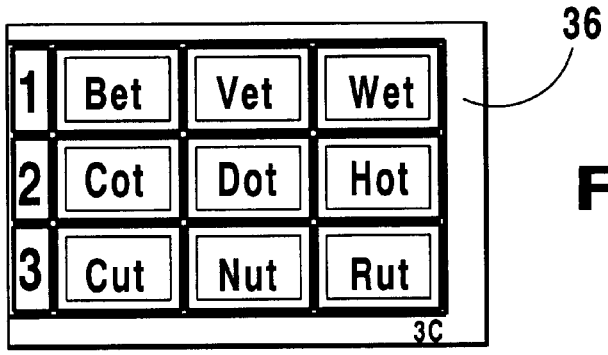
FIG. 3C is a top plan view, taken from FIG. 3 as indicated, showing another of the vocabulary boards in the third set of the vocabulary board game.

Turning to FIG. 3C, shown therein is a top plan view, taken from FIG. 3 as indicated, showing another of the game boards 36 in the third set of the board game.

Figure 3D:
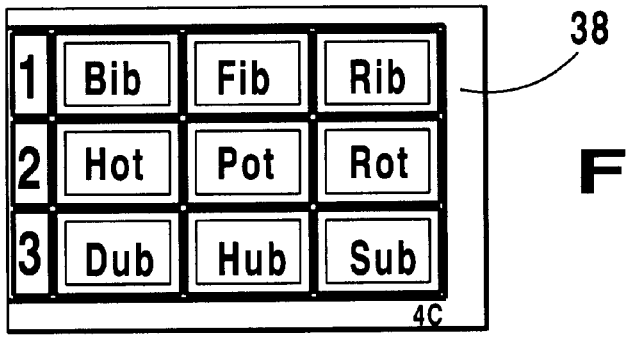
FIG. 3D is a top plan view, taken from FIG. 3 as indicated, showing another of the vocabulary boards in the third set of the vocabulary board game.

Turning to FIG. 3D, shown therein is a top plan view, taken from FIG. 3 as indicated, showing another of the game boards 38 in the third set of the board game.

Turning to FIG. 4, shown therein is a perspective view of the fourth set of game boards 40.

Figure 4A:
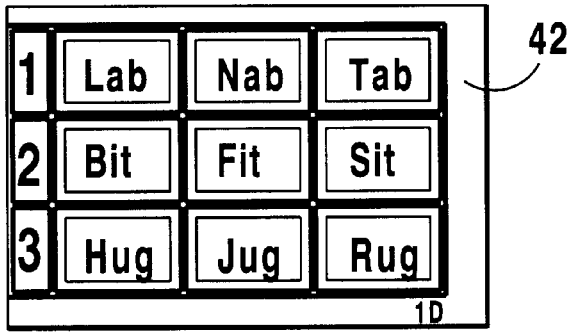
FIG. 4A is a top plan view, taken from FIG. 4 as indicated, showing one of the vocabulary boards in the fourth set of the vocabulary board game.

Turning to FIG. 4A, shown therein is a top plan view, taken from FIG. 4 as indicated, showing one of the game boards 42 in the fourth set of the board game.

Figure 4B:
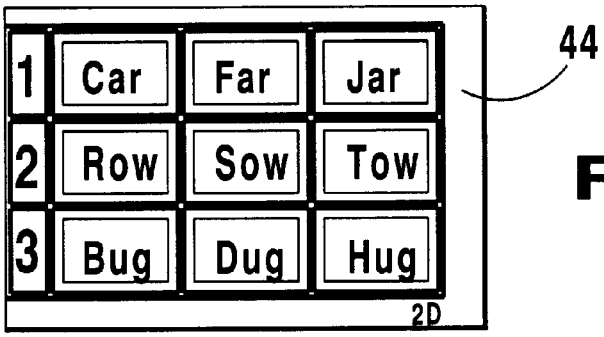
FIG. 4B is a top plan view, taken from FIG. 4 as indicated, showing another of the vocabulary boards in the fourth set of the vocabulary board game.

Turning to FIG. 4B, shown therein is a top plan view, taken from FIG. 4 as indicated, showing another of the game boards 44 in the fourth set of the board game.

Figure 4C:
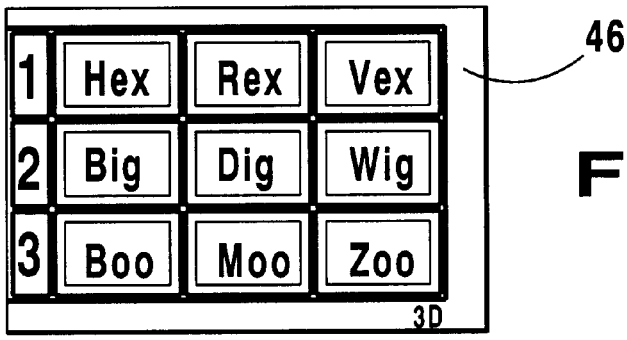
FIG. 4C is a top plan view, taken from FIG. 4 as indicated, showing another of the vocabulary boards in the fourth set of the vocabulary board game.

Turning to FIG. 4C, shown therein is a top plan view, taken from FIG. 4 as indicated, showing another of the game boards 46 in the fourth set of the board game.

Figure 4D:
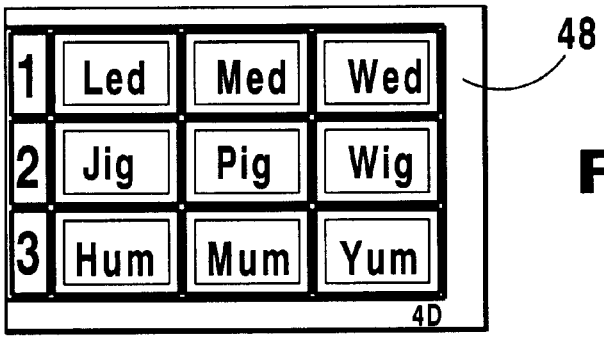
FIG. 4D is a top plan view, taken from FIG. 4 as indicated, showing another of the vocabulary boards in the fourth set of the vocabulary board game.

Turning to FIG. 4D, shown therein is a top plan view, taken from FIG. 4 as indicated, showing another of the game boards 48 in the fourth set of the board game.

Turning to FIG. 5, shown therein is a perspective view of the fifth set of game boards 50.

Figure 5A:
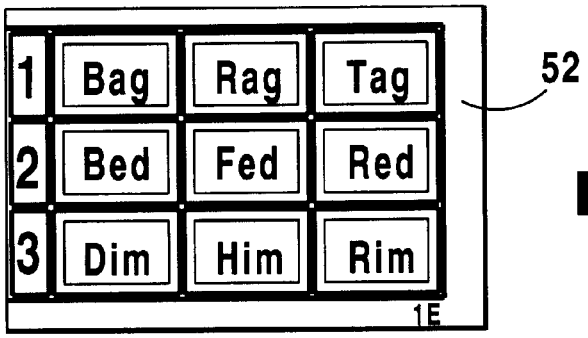
FIG. 5A is a top plan view, taken from FIG. 5 as indicated, showing one of the vocabulary boards in the fifth set of the vocabulary board game.

Turning to FIG. 5A, shown therein is a top plan view, taken from FIG. 5 as indicated, showing one of the game boards 52 in the fifth set of the board game.

Figure 5B:
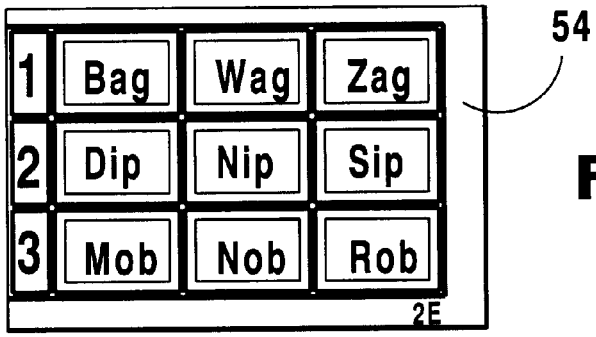
FIG. 5B is a top plan view, taken from FIG. 5 as indicated, showing another of the vocabulary boards in the fifth set of the vocabulary board game.

Turning to FIG. 5B, shown therein is a top plan view, taken from FIG. 5 as indicated, showing another of the game boards 54 in the fifth set of the board game.

Figure 5C:
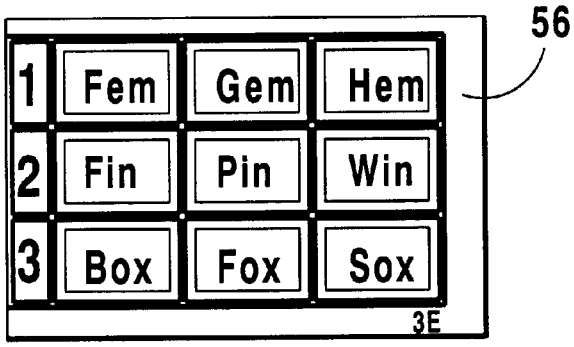
FIG. 5C is a top plan view, taken from FIG. 5 as indicated, showing another of the vocabulary boards in the fifth set of the vocabulary board game.

Turning to FIG. 5C, shown therein is a top plan view, taken from FIG. 5 as indicated, showing another of the game boards 56 in the fifth set of the board game.

Figure 5D:
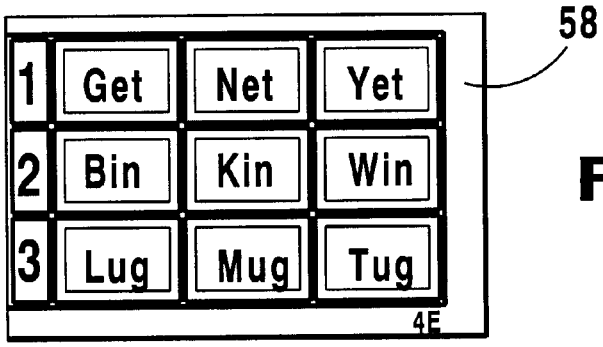
FIG. 5D is a top plan view, taken from FIG. 5 as indicated, showing another of the vocabulary boards in the fifth set of the vocabulary board game.

Turning to FIG. 5D, shown therein is a top plan view, taken from FIG. 5 as indicated, showing another of the game boards 58 in the fifth set of the board game.

Turning to FIG. 6, shown therein is a perspective view of a plurality of sets of vocabulary cards 60, 62, 64, 66 and 68.

Figure 6A:
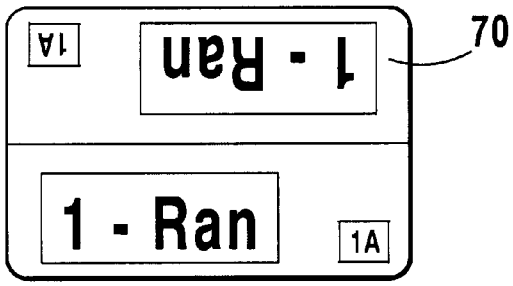
FIG. 6A is a top plan view, taken from FIG. 6 as indicated, showing one of the vocabulary cards belonging to the first set of vocabulary boards.

Turning to FIG. 6A, shown therein is a top plan view, taken from FIG. 6 as indicated, showing one of the vocabulary cards 70 belonging to the first set of game boards.

Figure 6B:
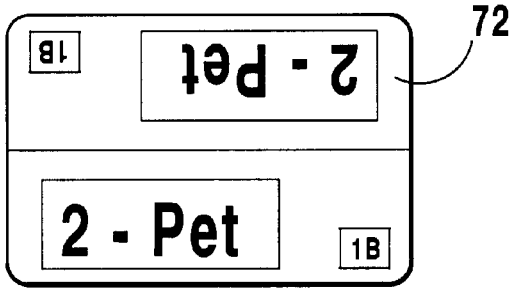
FIG. 6B is a top plan view, taken from FIG. 6 as indicated, showing one of the vocabulary cards belonging to the second set of vocabulary boards.

Turning to FIG. 6B, shown therein is a top plan view, taken from FIG. 6 as indicated, showing one of the vocabulary cards 72 belonging to the second set of game boards.

Figure 6C:
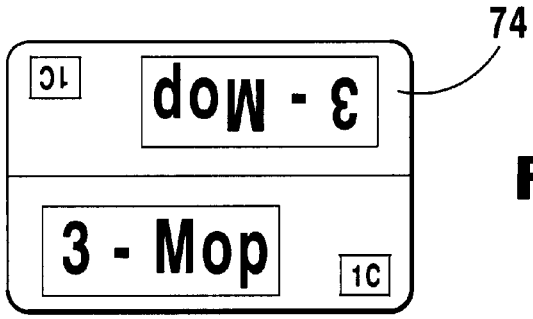
FIG. 6C is a top plan view, taken from FIG. 6 as indicated, showing one of the vocabulary cards belonging to the third set of vocabulary boards.

Turning to FIG. 6C, shown therein is a top plan view, taken from FIG. 6 as indicated, showing one of the vocabulary cards 74 belonging to the third set of game boards.

Figure 6D:
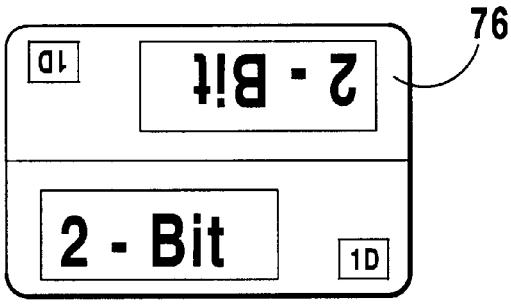
FIG. 6D is a top plan view, taken from FIG. 6 as indicated, showing one of the vocabulary cards belonging to the fourth set of vocabulary boards.

Turning to FIG. 6D, shown therein is a top plan view, taken from FIG. 6 as indicated, showing one of the vocabulary cards 76 belonging to the fourth set of game boards.

Figure 6E:
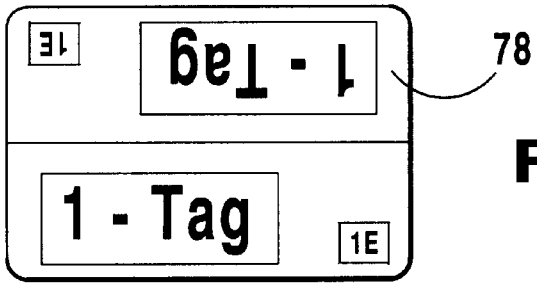
FIG. 6E is a top plan view, taken from FIG. 6 as indicated, showing one of the vocabulary cards belonging to the fifth set of vocabulary boards.

Turning to FIG. 6E, shown therein is a top plan view, taken from FIG. 6 as indicated, showing one of the vocabulary cards 78 belonging to the fifth set of game boards.

Turning to FIG. 7, shown therein is a perspective view of a deck of tokens 80 which are placed on the game board to cover the words which have been read and matched.

Figure 7A:
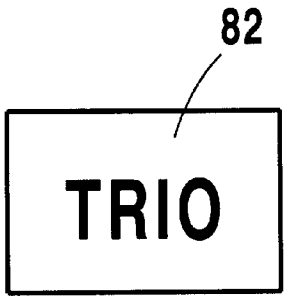
FIG. 7A is a top plan view, taken from FIG. 7 as indicated, showing one of the placement cards which are used to cover vocabulary words which have been read from the vocabulary cards.

Turning to FIG. 7A, shown therein is a top plan view, taken from FIG. 7 as indicated, showing one of the tokens 82 which are used to cover vocabulary words which have been read from the vocabulary cards.

Figure 7B:
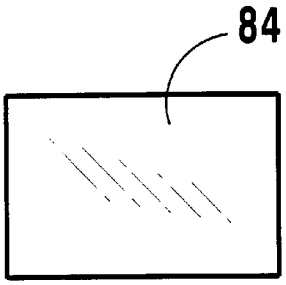
FIG. 7B is a bottom plan view, taken from FIG. 7 as indicated, showing one of the placement cards which are used to cover vocabulary words which have been read from the vocabulary cards.

Turning to FIG. 7B, shown therein is a bottom plan view, taken from FIG. 7 as indicated, showing one of the tokens 84 which are used to cover vocabulary words which have been read from the vocabulary cards.

Figure 8:
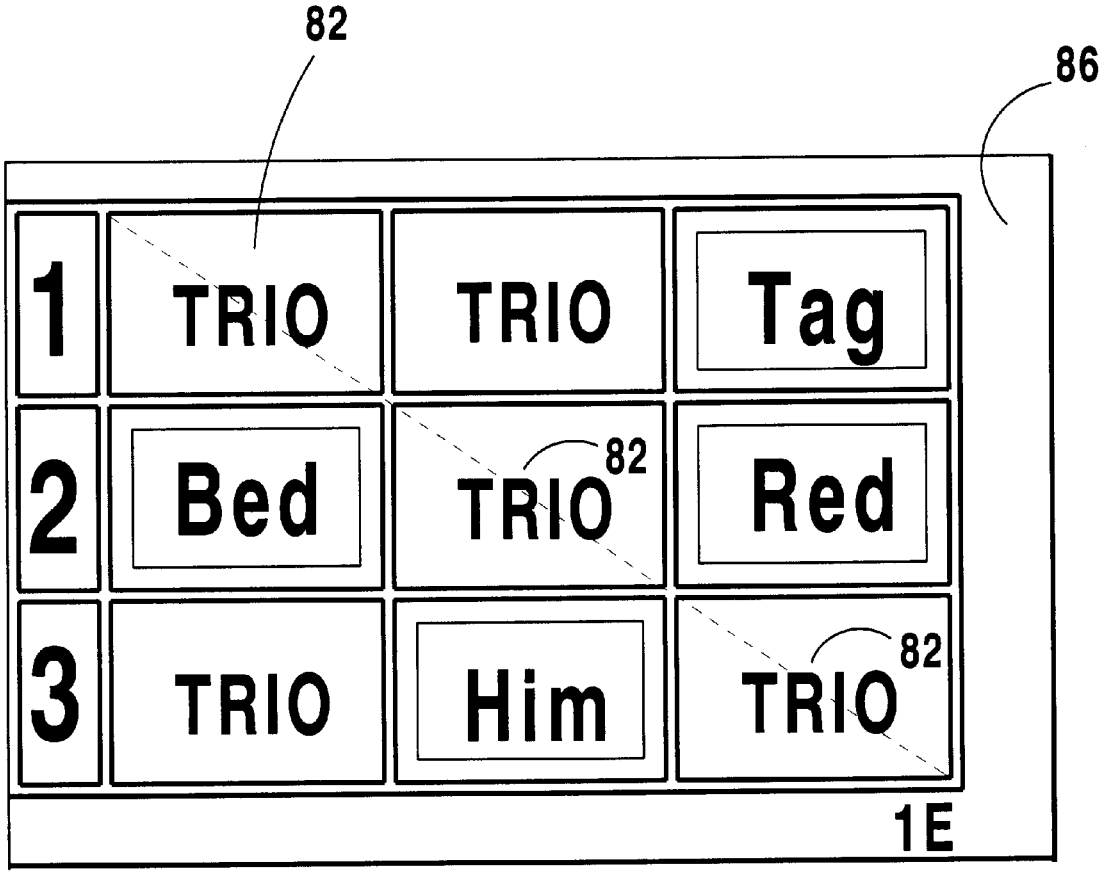
FIG. 8 is a top plan view of a vocabulary board in use taken from set E as shown in FIG. 5A. Shown is a number of the words located on the vocabulary board have been covered by placement card. Once a player has covered three words in a row or column or diagonally than that player yells out "TRIO" and the game is over.

Turning to FIG. 8, shown therein is a top plan view of a game board 86 in use taken from set E as shown in FIG. 5A. Shown are three words located on the vocabulary board covered by tokens 82. Once a player has covered three words in a row or column or diagonally than that player calls out "TRIO" and the game is over.

What is claimed is:

1. An method of playing a board game to teach the alphabet to at least two players in the age group of 4–6 years of age, consisting of the steps of:

a) providing a game board to each player in the designated age group defining a playing surface, said playing surface having a 3×3 matrix of spaces thereon, each of said spaces having a three-letter word imprinted therein, the words in each row having a common vowel;

b) providing vocabulary cards, each of said vocabulary cards containing a three-letter word, said three-letter word matching said three-letter word on at least one of said game boards;

c) shuffling said vocabulary cards, said shuffling producing a random order;

d) reading said vocabulary cards, said reading done aloud, said reading done by a player;

e) designating a player to read said vocabulary cards aloud;

f) providing a plurality of tokens to each player;

g) matching said word read from each vocabulary card to said word on said game board;

h) placing a token over each of said words read from each vocabulary card which match said word on said game board; and, i) repeating steps d, g and h until a player accumulates three tokens in a straight line.

2. The method of claim 1, further comprising-the step of providing five sets of game boards.

3. The method of claim 2, further comprising the step of providing one set of game boards numbered 1A, 2A, 3A and 4A.

4. The method of claim 2, further comprising the step of providing one set of game boards numbered 1B, 2B, 3B and 4B.

5. The method of claim 2, further comprising the step of providing one set of game boards numbered 1C, 2C, 3C and 4C.

6. The method of claim 2, further comprising the step of providing one set of game boards numbered 1D, 2D, 3D and 4D.

7. The method of claim 2, further comprising the step of providing one set of game boards numbered 1E, 2E, 3E and 4E.

8. The method of claim 1, further comprising the step of providing 180 vocabulary cards each of said vocabulary cards matching one of said game boards.

9. The method of claim 1, further comprising the step of providing 180 tokens.

10. A game for teaching the alphabet to children in the age group of 4–6 years consisting of:

a) a plurality of sets of game boards, each set having a number of said game boards, each game board having a playing surface with spaces formed into an equal number of rows and columns, each space containing a three letter word, and all of the words in the spaces in any single row having a common vowel in which the vowel is in the middle of each word;

b) a deck of randomly arranged vocabulary cards, each vocabulary card having a three-letter word corresponding to a three-letter word on one or more of said game boards; and c) a plurality of tokens.

* * * * *